US007793365B2

(12) United States Patent
Miura et al.

(10) Patent No.: US 7,793,365 B2
(45) Date of Patent: Sep. 14, 2010

(54) WATER DISCHARGE DEVICE

(75) Inventors: Shoji Miura, Fukuoka (JP); Emiko Sumimoto, Fukuoka (JP)

(73) Assignee: Toto Ltd (JP)

( * ) Notice: Subject to any disclaimer, the term of this patent is extended or adjusted under 35 U.S.C. 154(b) by 659 days.

(21) Appl. No.: 11/691,802

(22) Filed: Mar. 27, 2007

(65) Prior Publication Data

US 2007/0232108 A1 Oct. 4, 2007

(30) Foreign Application Priority Data

Mar. 29, 2006 (JP) ..... 2006-090418

(51) Int. Cl.
*E03C 1/04* (2006.01)

(52) U.S. Cl. ..... 4/678; 4/675; 4/615; 137/801; 137/360

(58) Field of Classification Search ..... 4/678, 4/675, 615, 676, 677; 137/801, 360; 285/193, 285/8, 32, 90, 91, 276, 404
See application file for complete search history.

(56) References Cited

U.S. PATENT DOCUMENTS 1,548,570 A * 8/1925 Wuesthoff ..... 285/137.11
1,790,316 A * 1/1931 Mueller ..... 285/137.11
2,997,058 A * 8/1961 Hall ..... 137/360
3,079,093 A * 2/1963 Bellows ..... 137/801
3,136,570 A * 6/1964 Lee ..... 4/678
6,195,818 B1 * 3/2001 Rodstein et al. ..... 4/678
6,267,145 B1 * 7/2001 Sun ..... 137/801
6,276,004 B1 * 8/2001 Bertrand et al. ..... 4/615
6,301,727 B1 * 10/2001 Bertrand et al. ..... 4/678
6,378,912 B1 * 4/2002 Condon et al. ..... 4/678
6,840,267 B1 * 1/2005 Jennings et al. ..... 137/360
6,918,400 B2 * 7/2005 Buchner et al. ..... 137/15.01
7,373,674 B1 * 5/2008 Condon ..... 4/678

FOREIGN PATENT DOCUMENTS

JP 2002167819 6/2002

* cited by examiner

*Primary Examiner*—Khoa D Huynh
(74) *Attorney, Agent, or Firm*—Brooks Kushman P.C.

(57) ABSTRACT

Disclosed is a water discharge device (1) provided with a device body (2) and a connector (4) and adapted to be attached to a feedwater pipe (6). The water discharge device comprises fixing means (8) for fixing the device body to the connector at a given installation position. The connector has a feedwater-pipe-joining portion (4*a*) adapted to be joined to the feedwater pipe, and a connector-side engaging thread portion (4*b*), and the device body has a body-side engaging thread portion (14) positioned in such a manner as to be engaged with the connector-side engaging thread portion once during an operation of attaching the device body to the connector, and located beyond the connector-side engaging thread portion after the device body is fixed at the installation position. The water discharge device of the present invention can reliably prevent falling-off of the device body.

4 Claims, 7 Drawing Sheets

WATER DISCHARGE DEVICE

CROSS-REFERENCE TO RELATED APPLICATIONS

This application claims foreign priority benefits under 35 U.S.C. §119(a)-(d) to JP 2006-090418, filed Mar. 29, 2006, which is hereby incorporated by reference in its entirety.

BACKGROUND OF THE INVENTION

1. Field of the Invention

The present invention relates to a water discharge device, and more particularly to a water discharge device provided with a device body and a connector and adapted to be attached to a feedwater pipe.

2. Description of the Related Art

Japanese Patent Laid-Open Publication No. 2002-167819 (JP 2002-167819A; Patent Publication 1) discloses a mounting structure for a water discharge device, such as a spout. This mounting structure comprises a connector member adapted to be joined to a feedwater pipe of a water line, and a spout body adapted to be fixed to the connector member, wherein the spout body is fixed to the connector member in such a manner that a setscrew screwed in the spout body is tightened up to allow a tip thereof to be pressed against the connector member.

In this type of water discharge device, such as a spout, if the setscrew gets loose during use, or if an operation of tightening up the setscrew is erroneously skipped during installation of the water discharge device, the spout body is likely to be detached from the connector member due to a water line pressure.

With a view to avoiding this problem, the mounting structure disclosed in the JP 2002-167819A includes a retaining pin fixed to an outer peripheral surface of the connector member. In an operation of attaching the spout body to the connector member, the connector member is received in the spout body in such a manner that a notch of a guide groove formed in an inner surface of the spout body is aligned with the retaining pin. Then, the spout body is rotated to a given fixed position where the notch of the guide groove is misaligned with the retaining pin. Thus, even if the setscrew drops out, the retaining pin is engaged with the guide groove of the spout body to prevent falling-off of the spout body.

In reality, there is the possibility that the setscrew drops out and further the notch of the guide groove and the retaining pin are accidentally aligned with each other due to rotation of the spout body. In this case, the mounting structure disclosed in the JP 2002-167819A will still have the problem about falling-off of the spout body. Particularly, in a type of water discharge device to be installed above user's head, such as a shower head, it is required to ensure higher safety.

SUMMARY OF THE INVENTION

It is therefore an object of the present invention to provide a water discharge device capable of more reliably preventing falling-off of a device body.

In order to achieve the above object, the present invention provides a water discharge device provided with a device body and a connector and adapted to be attached to a feedwater pipe. The water discharge device comprises fixing means for fixing the device body to the connector at a given installation position, wherein the connector has a feedwater-pipe-joining portion adapted to be joined to the feedwater pipe, and a connector-side engaging thread portion, and the device body has a body-side engaging thread portion positioned in such a manner as to be engaged with the connector-side engaging thread portion once during an operation of attaching the device body to the connector, and located beyond the connector-side engaging thread portion after the device body is fixed at the installation position.

In the above water discharge device of the present invention, the feedwater-pipe-joining portion of the connector is firstly fixed to the feedwater pipe. In the operation of attaching the device body to the connector, the body-side engaging thread portion of the device body is engaged with the connector-side engaging thread portion of the connector once. Then, when the body-side engaging thread portion is further rotated relative to the connector-side engaging thread portion, the body-side engaging thread portion is moved beyond the connector-side engaging thread portion. Then, the fixing means is operated to fix the device body to the connector at the given installation position where the body-side engaging thread portion is located beyond the connector-side engaging thread portion.

Thus, even when the fixed state of the device body based on the fixing means is released due to long-term use or other factor, the engaging relationship between the device body and the connector is be maintained by the body-side engaging thread portion and the connector-side engaging thread portion. This engaging relationship between the device body and the connector can be released only if the device body is moved to axially align the body-side engaging thread portion with the connector-side engaging thread portion and then rotated in a given direction. This makes it possible to prevent an accidental release of the engaging relation causing falling-off of the device body.

Preferably, the water discharge device of the present invention further includes sealing means adapted to provide water-tightness between the device body and the connection. In this case, the water discharge device may be designed such that the sealing means loses the water-tightness when the device body is displaced from the installation position.

In this water discharge device, if the device body is displaced from the given or proper installation position, the water-tightness between the device body and the connector is lost to cause water leakage. This makes it possible to allow a user to immediately recognize that the device body is displaced from the proper installation position.

Preferably, in the water discharge device of the present invention, the fixing means is a setscrew which is screwed in the device body and adapted to allow a tip thereof to be in contact with the connector.

In this water discharge device, after adjusting an installation angle of the device body relative to the connector, the setscrew is tightened up to fix the device body. This makes it possible to reliably prevent falling-off of the device body while ensuring adjustability of the installation angle of the device body.

Preferably, in the water discharge device of the present invention, the fixing means is a pair of fixing thread portions formed, respectively, in the device body and the connector, and adapted to be threaded with each other.

In this water discharge device, the body-side engaging thread portion of the device body is engaged with the connector-side engaging thread portion of the connector once. After the body-side engaging thread portion is moved beyond the connector-side engaging thread portion, the respective fixing thread portions formed in the device body and the connector are engaged with each other to fix the device body to the connector. This makes it possible to more firmly fix the device body to the connector.

Preferably, in the above water discharge device, either one of the body-side engaging thread portion and the connector-side engaging thread portion additionally serves as either one of the pair of fixing thread portions.

Thus, either one of the body-side engaging thread portion and the connector-side engaging thread portion can additionally serve as either one of the pair of fixing thread portions to achieve the fixing of the device body based on the fixing thread portion in a simplified structure.

Preferably, in the above water discharge device, the body-side engaging thread portion additionally serves as the fixing thread portion formed in the device body, and the fixing thread portion of the device body has a length less than a distance between the connector-side engaging thread portion and the fixing thread portion formed in the connector and located on the proximal side of the connector relative to the connector-side engaging thread portion.

In this water discharge device, if the body-side engaging thread portion is disengaged from the fixing thread portion of the connector, the body-side engaging thread portion will be located at a position between the connector-side engaging thread portion and the fixing thread portion of the connector. The engaging relationship between the body-side engaging thread portion and the connector-side engaging thread portion can be released only if these engaging thread portions are axially aligned with each other once again. This makes it possible to more reliably prevent the device body from accidentally falling off the connector.

As above, the water discharge device of the present invention can more reliably prevent falling off of the device body.

DESCRIPTION OF THE PREFERRED EMBODIMENTS OF THE INVENTION

With reference to the accompanying drawings, an embodiment of the present invention will now be described.

Figure 1:
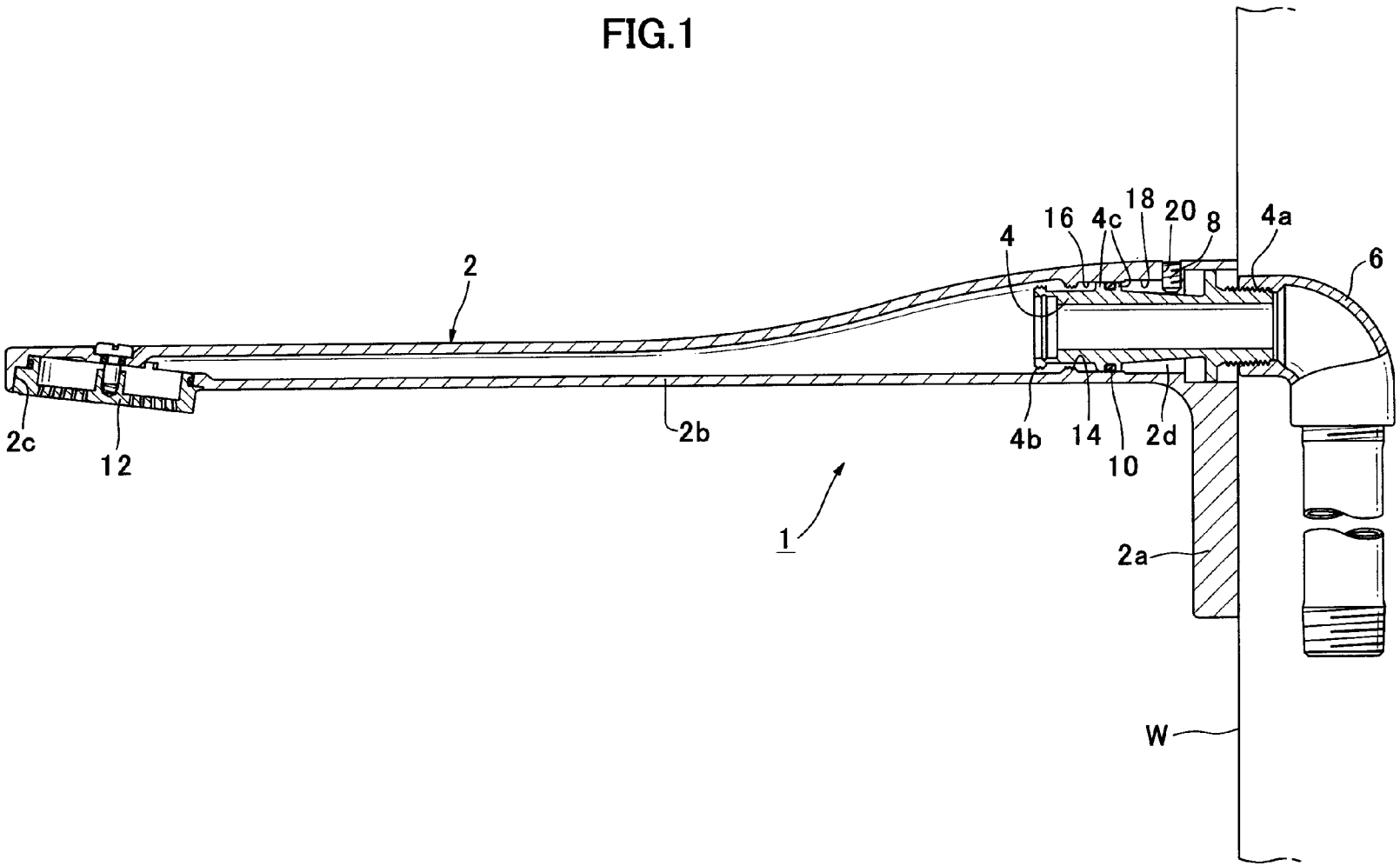
FIG. 1 is a sectional view of a showerhead according to a first embodiment of the present invention.
Figure 2:
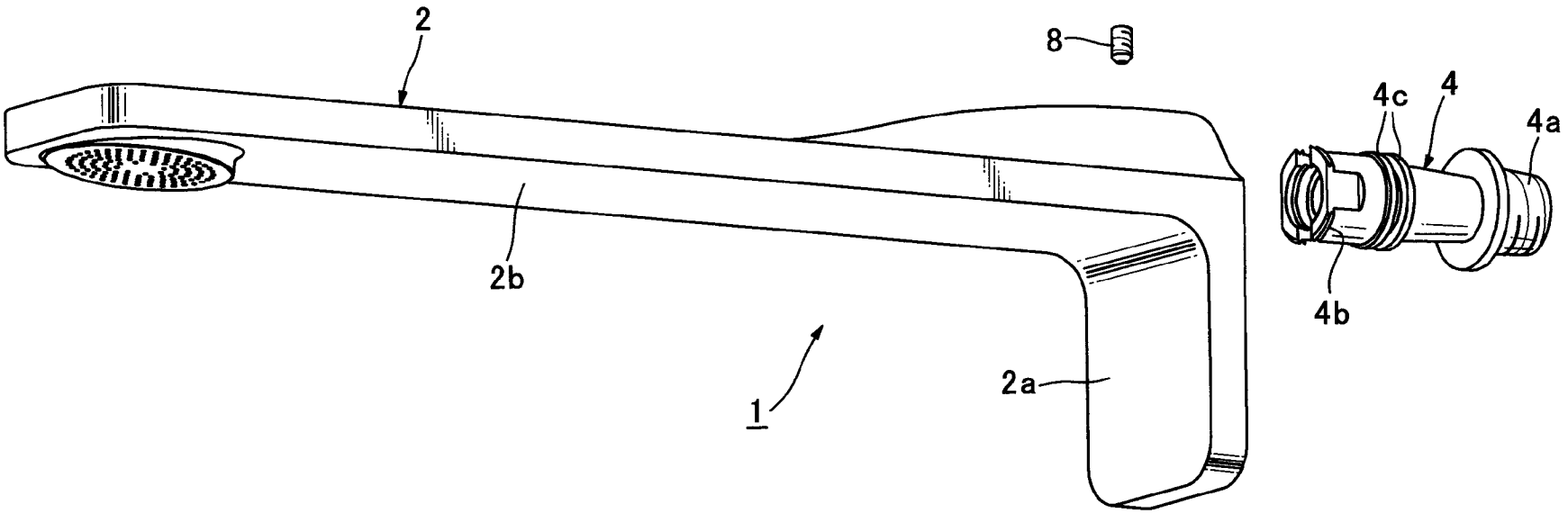
FIG. 2 is an exploded perspective view of the showerhead according to the first embodiment.
Figure 3:
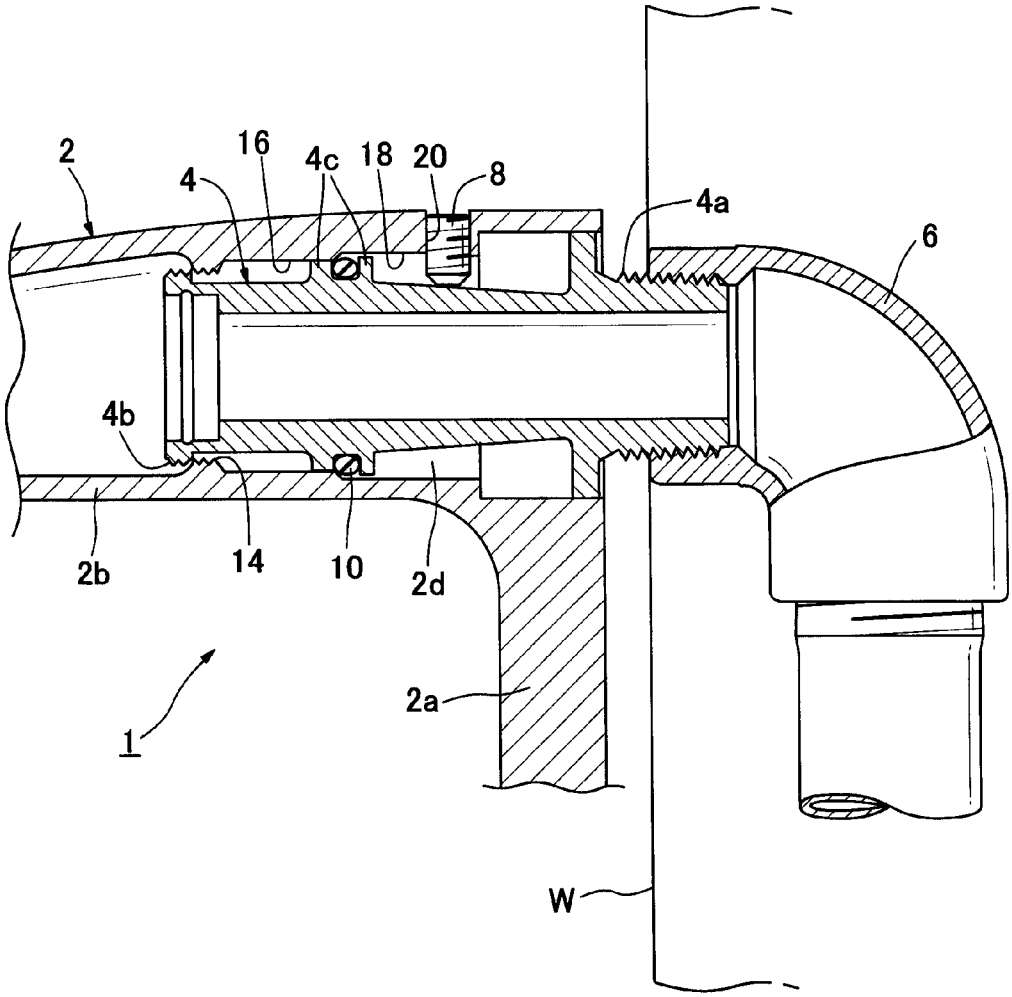
FIG. 3 is a fragmentary enlarged sectional view of the showerhead according to the first embodiment, wherein a showerhead body is displaced from a proper installation position.

Firstly, with reference to FIGS. 1 to 3, a first embodiment of an overhead-showering showerhead or a water discharge device according to the present invention will be described. FIG. 1 is a sectional view of the showerhead, and FIG. 2 is an exploded perspective view of the showerhead. FIG. 3 is a fragmentary enlarged sectional view of the showerhead wherein a showerhead body is displaced from a proper installation position.

As shown in FIGS. 1 and 2, the showerhead 1 according to the first embodiment comprises a showerhead body 2 which serves as a device body, a connector 4 adapted to be joined to a feedwater pipe 6 arranged in a wall W, and a setscrew 8 which serves as fixing means for fixing the showerhead body 2 to the connector 4. The showerhead 1 further includes an O-ring 10 which serves as sealing means disposed between the connector 4 and the showerhead body 2 to ensure water-tightness therebetween.

The showerhead body 2 is a generally L-shaped member which has a base section 2*a* adapted to be disposed in contact with the wall W for mounting the showerhead 1 thereon, and a horizontal section 2*b* extending horizontally from an upper end of the base section 2*a*. The horizontal section 2*b* has an internal space formed as a water flow passage for passing therethrough cold/hot water to be discharged, and a distal end formed with a water discharge opening 2*c*. The water discharge opening 2*c* is adapted to allow a water spray plate 12 formed with a great number of water spray holes to be mounted thereto.

The horizontal section 2*b* has a base end formed as a cylindrical-shaped connector receiving region 2*d* for receiving therein a distal end of the connector 4. The connector receiving region 2*d* has a distalmost end formed as an engaging internally-threaded protrusion 14 which serves as a body-side engaging thread portion. Further, the connector receiving region 2*d* includes a water-sealing cylindrical portion 16 formed on the side of the base end relative to the engaging internally-threaded protrusion 14 and adapted to be in close contact with the O-ring 10 so as to ensure water-tightness, and a large-diameter portion 18 formed on the side of the base end relative to the water-sealing cylindrical portion 16 to have an inner diameter greater than that of the water-sealing cylindrical portion 16. The setscrew 8 is adapted to be screwed into an internal thread 20 formed in a top wall of the horizontal section 2*b* in a radial direction of the connector receiving region 2*d*. Specifically, the internal thread 20 is formed to extend to penetrate through the large-diameter portion 18 of the connector receiving region 2*d*.

The connector 4 is a generally cylindrical-shaped member internally formed with a water flow passage. The connector 4 has a base end formed as a taper-shaped externally-threaded portion 4*a* which serves as a feedwater-pipe-joining portion adapted to be water-tightly engaged with the feedwater pipe 6 arranged in the wall W. The connector 4 has a distal end formed as an engaging externally-threaded protrusion 4*b* which serves as a connector-side engaging thread portion adapted to be engaged with the engaging internally-threaded protrusion 14 of the showerhead body 2 once during an operation of attaching the showerhead body 2 to the connector 4. Each of the engaging internally-threaded protrusion 14 and the engaging externally-threaded protrusion 4*b* has a relatively short length equivalent to about two threads. The connector 4 further includes two annular-shaped protrusions 4*c* formed on an outer peripheral surface thereof between the taper-shaped externally-threaded portion 4*a* and the engaging externally-threaded protrusion 4*b* to position the O-ring 10 therebetween.

With reference to FIGS. 1 to 3, an operation of installing the showerhead 1 according to the first embodiment will be described below.

As a first step, the taper-shaped externally-threaded portion 4*a* of the connector 4 is threaded with a reverse taper-shaped internally-threaded end of the feedwater pipe 6 arranged in the wall W, to fix the connector 4 to the feedwater pipe 6. In this step, a sealing material may be applied on the taper-shaped externally-threaded portion 4*a* in advance to reliably ensure water-tightness between the connector 4 and the feedwater pipe 6.

Then, the showerhead body 2 is attached to the connector 4. In this step, the showerhead body 2 is firstly disposed to allow the connector receiving region 2*d* of the showerhead body 2 to receive therein the connector 4 fixed in such a manner as to protrude from the wall W. Then, when the connector 4 is inserted into the connector receiving region 2*d* of the showerhead body 2, the engaging externally-threaded protrusion 4*b* at the distal end of the connector 4 is brought into contact with the engaging internally-threaded protrusion 14 at the distalmost end of the connector receiving region 2*d*. In this position, the showerhead body 2 is moved to align an axis of the engaging internally-threaded protrusion 14 with the engaging externally-threaded protrusion 4*b*, and then rotated to engage the engaging internally-threaded protrusion 14 with the engaging externally-threaded protrusion 4*b*. As mentioned above, each of the engaging externally-threaded protrusion 4*b* and the engaging internally-threaded protrusion 14 has about two threads. Thus, when the showerhead body 2 is rotated about two turns relative to the connector 4, the engaging internally-threaded protrusion 14 of the showerhead body 2 is moved beyond the engaging externally-threaded protrusion 4*b* of the connector 4 to release the thread engagement therebetween, as shown in FIG. 3. From this released position, the showerhead body 2 can be simply pushed toward the wall W without an operation of rotating the showerhead body 2, while allowing the connector 4 to be further inserted into the connector receiving region 2*d*.

In conjunction with the operation of pushing the showerhead body 2 toward the wall W from the position illustrated in FIG. 3, the O-ring 10 fitted on the outer peripheral surface of the connector 4 is moved from the large-diameter portion 18 into the water-sealing cylindrical portion 16 of the connector receiving region 2*d*. This makes it possible to ensure water-tightness between the connector 4 and the showerhead body 2. The, the showerhead body 2 is further pushed until the base section 2*a* comes into contact with the wall W. In this position, the showerhead body 2 is rotated to adjust an installation angle in such a manner that the top wall of the horizontal section 2*b* is accurately oriented upwardly, and the setscrew 8 is tightened up, as the final step. Through the tightening of the setscrew 8, a tip of the setscrew 8 is pressed against the outer peripheral surface of the connector 4 to allow the showerhead body 2 to be fixed to the connector 4.

In use of the showerhead 1 according to the first embodiment, cold/hot water supplied from the feedwater pipe 6 is discharged from the water spray holes of the water spray plate 12 via the water flow passage of the connector 4 and the water flow passage of the horizontal section 2*b*. During the use, due to a feedwater pressure, the showerhead body 2 receives a force in a direction causing the showerhead body 2 to be pulled out of the connector 4, and a force causing vibrations of the showerhead body 2. In normal use conditions, the showerhead body 2 fixed by the setscrew 8 is never pulled out of the connector 4 even if it receives such a feedwater pressure. Further, during the operation of attaching the showerhead body 2, the engaging internally-threaded protrusion 14 of the showerhead body 2 has been engaged with the engaging externally-threaded protrusion 4*b* of the connector 4 once and then moved beyond the engaging externally-threaded protrusion 4*b*. Thus, even if the showerhead body 2 is displaced in the direction causing pullout from the connector 4 due to insufficient tightening force of the setscrew 8 or erroneous skipping of an operation of tightening up the setscrew 8, the engaging internally-threaded protrusion 14 of the showerhead body 2 will be brought into contact with, i.e., engaged by, the engaging externally-threaded protrusion 4*b* of the connector 4, to prevent the showerhead body 2 from falling off the connector 4. That is, the showerhead body 2 never falls off the connector 4, because the showerhead body 2 can be pulled out of the connector 4 only if the showerhead body 2 is axially aligned with the connector 4 and then rotated about two turns while engaging the engeging internally-threaded protrusion 14 with the engaging externally-threaded protrusion 4*b*.

In addition, if the showerhead body 2 is displaced from the proper installation position illustrated in FIG. 1 to the position illustrated in FIG. 3, the O-ring 10 which has been in close contact with the water-sealing cylindrical portion 16 of the connector receiving region 2*d* will face the large-diameter portion 18 of the connector receiving region 2*d*. Thus, in response to displacement of the showerhead body 2 from the proper installation position, the water-tightness based on the O-ring 10 is lost. This causes leakage of cold/hot water from between the showerhead body 2 and the connector 4 to outside, to allow a user to immediately recognize that the showerhead body 2 is displaced from the proper installation position.

In the showerhead according the first embodiment, even when the setscrew becomes loose due to long-term use or other factor, the engaging relationship between the engaging internally-threaded protrusion of the showerhead body and the engaging externally-threaded protrusion of the connector can be maintained to more reliably prevent falling-off of the showerhead body.

Further, in the showerhead according the first embodiment, if the showerhead body is displaced from the proper installation position, the water-tightness based on the O-ring 10 is lost to cause water leakage. This makes it possible to allow a user to immediately recognize that the showerhead body is displaced from the proper installation position.

Furthermore, in the showerhead according the first embodiment, the showerhead body is fixed to the connector by the setscrew. This makes it possible to reliably prevent falling-off of the showerhead body while ensuring adjustability of the installation angle of the showerhead body.

In the showerhead according the first embodiment, the engaging internally-threaded protrusion is formed in the showerhead body, and the engaging externally-threaded protrusion is formed in the connector. Alternatively, this relationship may be reversed. That is, the engaging externally-threaded protrusion may be formed in the showerhead body, and the engaging internally-threaded protrusion may be formed in the connector.

Figure 4:
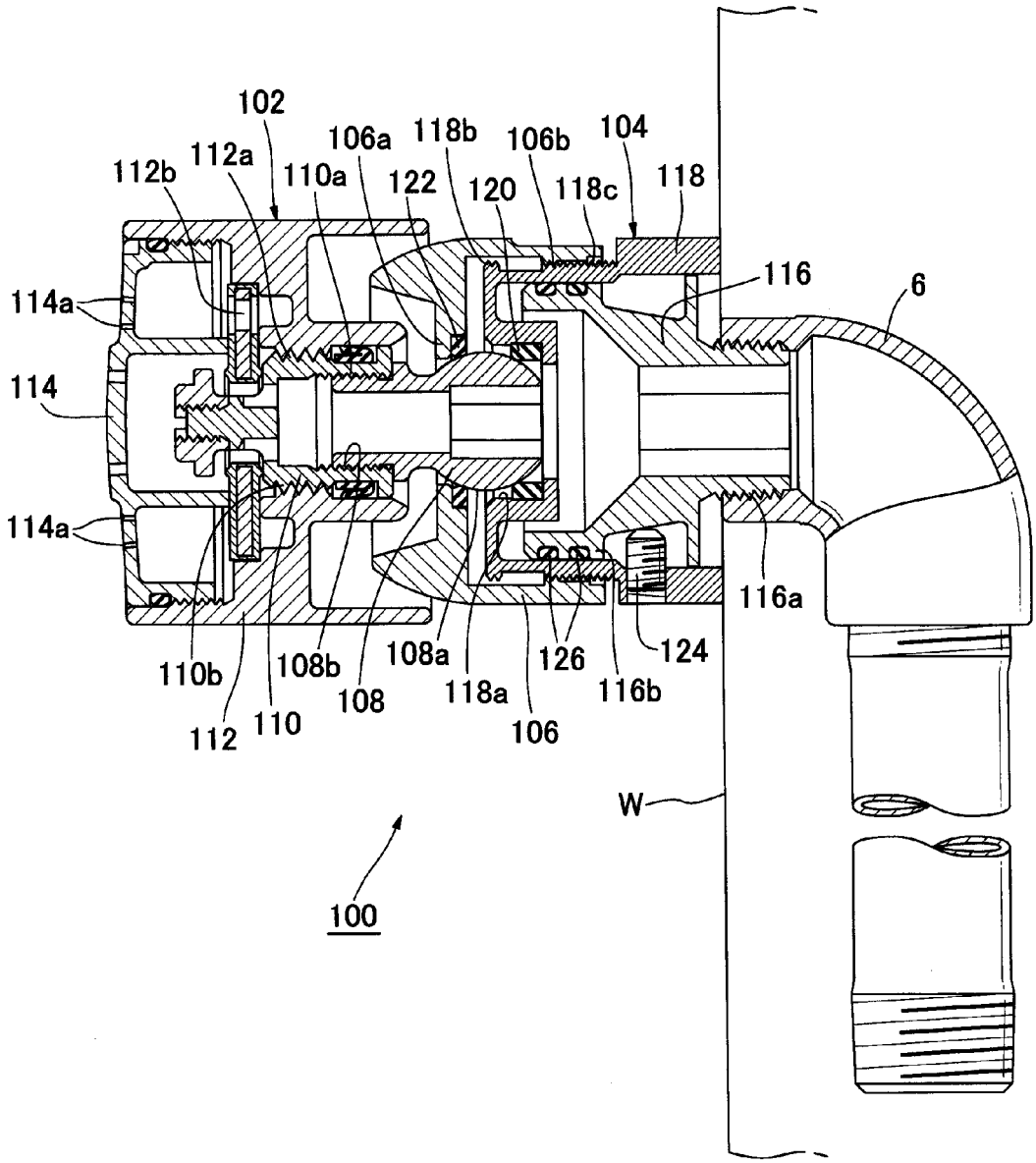
FIG. 4 is a sectional view of a body-showering showerhead according to a second embodiment of the present invention.
Figure 5:
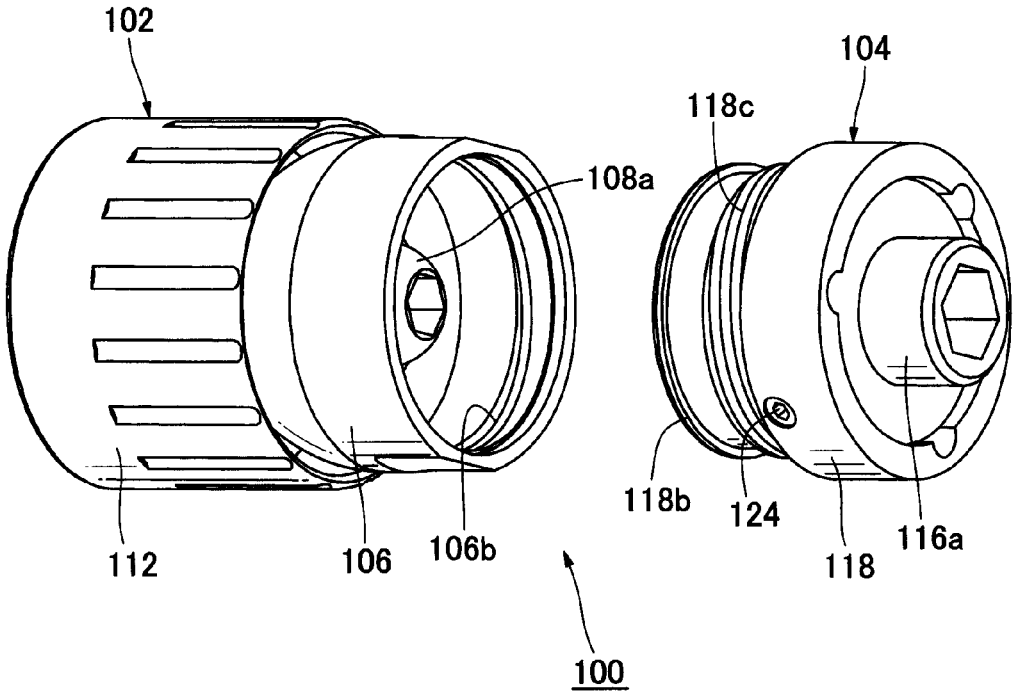
FIG. 5 is an exploded perspective view of the body-showering showerhead according to the second embodiment.

With reference to FIGS. 4 and 5, a second embodiment of a body-showering showerhead or a water discharge device according to the present invention will be described below. FIG. 4 is a sectional view of the body-showering showerhead, and FIG. 5 is an exploded perspective view of the body-showering showerhead.

As shown in FIGS. 4 and 5, the body-showering showerhead 100 according to the second embodiment comprises a showerhead body 102 which serves as a device body adapted to be attached in a swingable manner, a connector 104 adapted to be joined to a feedwater pipe 6 arranged in a wall W.

The showerhead body 102 includes a fixing cover 106 for fixing the showerhead body 102 to the connector 104, a pivot shaft 108 adapted to be swingably clamped between the fixing cover 106 and the connector 104, a frame member 112 having a water spray plate 114 attached thereto, and an adaptor 110 for connecting the pivot shaft 108 and the frame member 112 together.

The connector 104 includes a feedwater-pipe-joining member 116 adapted to be joined to the feedwater pipe 6, and a pivot-receiving member 118 disposed to cover the feedwater-pipe-connection member 116 and adapted to receive therein the pivot shaft 108.

The feedwater-pipe-joining member 116 is a generally cylindrical-shaped member formed with a water flow passage extending in an axial direction thereof. The feedwater-pipe-joining member 116 has a taper-shaped externally-threaded portion 116*a* which serves as a feedwater-pipe-joining portion adapted to be engaged with a reverse taper-shaped internally-threaded end of the feedwater pipe 6, and a water-sealing cylindrical portion 116*b* formed to have a diameter greater than that of the taper-shaped externally-threaded portion 116*a* and adapted to be water-tightly received in the pivot-receiving portion 118. The water-sealing cylindrical portion 116*b* has an outer peripheral surface formed with two annular-shaped grooves each receiving therein an O-ring 126.

The pivot-receiving member 118 is a generally cylindrical-shaped member adapted to receive therein the feedwater-pipe-joining member 116 and cover the feedwater-pipe-joining member 116. The pivot-receiving member 118 has a distal end wall formed with a circular-shaped pivot-receiving concave portion 118*a* for receiving therein the pivot shaft 108. An annular-shaped packing 120 is disposed on a bottom of the pivot-receiving concave portion 118*a* to ensure water-tightness between the pivot shaft 108 and the pivot-receiving concave portion 118*a*.

The pivot-receiving member 118 has a distal end formed as an engaging externally-threaded protrusion 118*b* which serves as a connector-side engaging thread portion. In the second embodiment, the engaging externally-threaded protrusion 118*b* is formed to have about two threads. Further, the pivot-receiving member 118 has an axially intermediate portion formed as a fixing externally-threaded portion 118*c*. The engaging externally-threaded protrusion 118*b* and the fixing externally-threaded portion 118*c* are formed in a concentric arrangement and in spaced-apart relation to each other by a distance greater than an after-mentioned engaging internally-threaded protrusion 106*b* formed in the fixing cover 106. Further, a setscrew 124 is screwed in a based end of the pivot-receiving member 118 to extend in a radial direction of the pivot-receiving member 118, and adapted to be tightened up so as to integrate the pivot-receiving member 118 with the feedwater-pipe-joining member 116.

The pivot shaft 108 is a generally cylindrical-shaped member formed with a water flow passage extending in an axial direction thereof. The pivot shaft 108 has a base end with an outer surface formed as a spherical surface 108*a* for allowing the showerhead body 102 to be pivotally connected to the connector 104, and a distal end formed as a connecting externally-threaded portion 108*b* threadingly engageable with the adaptor 110.

The fixing cover 106 is a generally cylindrical-shaped member adapted to be threadingly engaged with the pivot-receiving member 118 to clamp the pivot shaft 108 in cooperation with the pivot-receiving member 118. The fixing cover 106 has a doughnut-shaped clamping portion 106*a* formed to surround the pivot shaft 108, and an annular-shaped resin member 122 is disposed around an inner peripheral surface of the clamping portion 106*a*. Thus, the spherical surface 108*a* of the pivot shaft 108 can be clamped between the resin member 122 and the packing 120 disposed in the pivot-receiving concave portion 118*a*, to support the pivot shaft 108 in a pivotally swingable manner.

The fixing cover 106 has a base end formed as an engaging internally-threaded protrusion 106*b* which serves as a body-side engaging thread portion. In an operation of attaching the fixing cover 106 to the pivot-receiving member 118, the engaging internally-threaded protrusion 106*b* is engaged with the engaging externally-threaded protrusion 118*b* of the pivot-receiving member 118 once. Then, the engaging internally-threaded protrusion 106*b* after being moved beyond the engaging externally-threaded protrusion 118*b* is engaged with the fixing externally-threaded portion 118*c* to fix the fixing cover 106 to the pivot-receiving member 118. That is, the engaging internally-threaded protrusion 106*b* serves as both a body-side engaging thread portion adapted to be engaged with the engaging externally-threaded protrusion 118*b*, and a fixing thread portion or fixing means for attaching the showerhead body 102 to the connector 104. In this embodiment, the engaging internally-threaded protrusion 106*b* is formed to have about two threads.

The adaptor 110 is a generally cylindrical-shaped member formed with a water flow passage extending in an axial direction thereof. The adaptor 110 has a base end formed as a connecting internally-threaded portion 110*a* engageable with the connecting externally-threaded portion 108*b* of the pivot shaft 108. Further, the adaptor 110 has a distal end formed as a connecting externally-threaded portion 110*b* threadingly engageable with the frame member 112.

The frame member 112 is a generally cylindrical-shaped member disposed to surround the respective distal ends of the adaptor 110 and the fixing cover 106, and a water spray plate 114 formed with a great number of water spray holes 114*a* is attached to a distal end wall thereof. The frame member 112 is formed with a connecting internally-threaded portion 112*a* adapted to be threadingly engaged with the adaptor 110 after receiving therein the adaptor 110, and a water flow passage for leading cold/hot water discharged from a distal end of the water flow passage of the adaptor 110, to the water spray plate 114.

With reference to FIGS. 4 and 5, an operation of installing the body-showering showerhead 100 according to the second embodiment will be described below.

As a first step, the taper-shaped externally-threaded portion 116*a* of the feedwater-pipe-joining member 116 is engaged with the reverse taper-shaped internally-threaded end of the feedwater pipe 6 arranged in the wall W, to fix the taper-shaped externally-threaded portion 116*a* to the feedwater pipe 6.

The fixing cover 106, the pivot shaft 108, the adaptor 110, the frame member 112 and the water spray plate 114 are assembled together in advance as shown in FIG. 4, and this assembled unit is attached to the pivot-receiving member 118. Specifically, the fixing cover 106 is moved to align an axis of the engaging internally-threaded protrusion 106*b* formed as the base end of the fixing cover 106, with that of the engaging externally-threaded protrusion 118*b* formed as the distal end of the pivot-receiving member 118, and then rotated to engage the engaging internally-threaded protrusion 106*b* with the engaging externally-threaded protrusion 118*b*. As mentioned above, each of the engaging internally-threaded protrusion 106*b* and the engaging externally-threaded protrusion 118*b* is formed to have about two threads. Thus, after the engaging internally-threaded protrusion 106*b* and the engaging externally-threaded protrusion 118*b* are engaged with each other, the fixing cover 106 can be rotated about two turns to allow the engaging internally-threaded protrusion 106*b* to be moved beyond the engaging externally-threaded protrusion 118*b*.

The engaging internally-threaded protrusion 106*b* after being moved beyond the engaging externally-threaded protrusion 118*b* is located in a non-threaded region of the pivot-receiving member 118 between the engaging externally-threaded protrusion 118*b* formed as the distal end thereof and the fixing externally-threaded portion 118*c* formed as the axially intermediate portion thereof. While the fixing cover 106 is displaceable relative to the pivot-receiving member 118 when it is located in the non-threaded region, the engaging internally-threaded protrusion 106*b* is brought into contact with, i.e., engaged by, the engaging externally-threaded protrusion 118*b* to preclude the fixing cover 106 from being pulled out of the pivot-receiving member 118.

Then, the fixing cover 106 is moved to align the axis of the engaging internally-threaded protrusion 106*b* of the fixing cover 106 with an axis of the fixing externally-threaded portion 118*c* of the pivot-receiving member 118, and then rotated to engage the engaging internally-threaded protrusion 106*b* with the fixing externally-threaded portion 118*c*. When the fixing cover 106 is screwed into the pivot-receiving member 118, the spherical surface 108*a* of the pivot shaft 108 is clamped between the packing 120 and the resin member 122. When the fixing cover 106 is further threadingly moved up to a given position, the packing 120 and the resin member 122 are adequately compressed to ensure water-tightness between the pivot-receiving member 118 and the pivot shaft 108. In this position, the showerhead body 102 can be pivotally swung based on a sliding movement of the spherical surface 108*a* of the pivot shaft 108 relative to the packing 120, and then stopped at any position based on friction between the spherical surface 108*a* and the packing 120.

As the final step, the pivot shaft 118 assembled with the fixing cover 106, the frame member 112 and others is attached to cover the feedwater-pipe-joining member 116 mounted on the wall W in advance, and then the setscrew 124 is tightened up. Thus, the pivot-receiving member 118 is fixed in such a manner that an edge of the base end is in contact with the wall W. Water-tightness between the feedwater-pipe-joining member 116 and the pivot-receiving member 118 is ensured by the two O-rings 126.

In an actual use of the body-showering showerhead 100 according to the second embodiment, cold/hot water supplied from the feedwater pipe 6 is discharged from the water spray holes 114*a* of the water spray plate 114 via the respective water flow passages of the feedwater-pipe-joining member 116, the pivot shaft 108, the adaptor 110 and the frame member 112. According to user's preference, the showerhead body 102 can be swingingly moved in any direction and stopped at an intended position.

Even if fastening based on the thread engagement between the pivot-receiving member 118 and the fixing cover 106 becomes loose due to long-term use, water-tightness between the pivot shaft 108 and the packing 120 will be lost to cause leakage of cold/hot water from therebetween to outside. This makes it possible to allow a user to immediately recognize that the showerhead body 102 is displaced from a given or proper installation position due to loose in fastening of the fixing cover 106. Further, even if the engaging internally-threaded protrusion 106*b* of the fixing cover 106 is disengaged from the fixing externally-threaded portion 118*c* of the pivot-receiving member 118, the engaging internally-threaded protrusion 106*b* will be brought into contact with, i.e., engaged by, the engaging externally-threaded protrusion 118*b* of the pivot-receiving member 118 to prevent that falling-off of the showerhead body 102.

In the body-showering showerhead according the second embodiment, the showerhead body is fixed to the connector by the fixing externally-threaded portion. Thus, the showerhead body can be more firmly fixed.

In the body-showering showerhead according the second embodiment, the engaging internally-threaded protrusion additionally serves as a fixing internally-threaded portion. Thus, the structure of the showerhead can be further simplified.

In the body-showering showerhead according the second embodiment, the distance between the engaging externally-threaded protrusion and the fixing externally-threaded portion of the pivot-receiving member is greater than the length of the engaging internally-threaded protrusion of the fixing cover. Thus, the disengagement between the engaging internally-threaded protrusion and the fixing externally-threaded portion triggers the need for aligning the axis of the engaging internally-threaded protrusion with that of the engaging externally-threaded protrusion again. This makes it possible to more reliably prevent the showerhead body from accidentally falling off the connector.

In the second embodiment, the engaging internally-threaded protrusion is designed to additionally serve as a fixing internally-threaded portion of the fixing cover. Alternatively, the engaging internally-threaded protrusion may be an engaging internally-threaded protrusion designed to additionally serve as a fixing internally-threaded portion. Further, both of fixing internally-threaded and externally-threaded portions may be formed independently of the corresponding engaging internally-threaded and externally-threaded protrusions.

Figure 6:
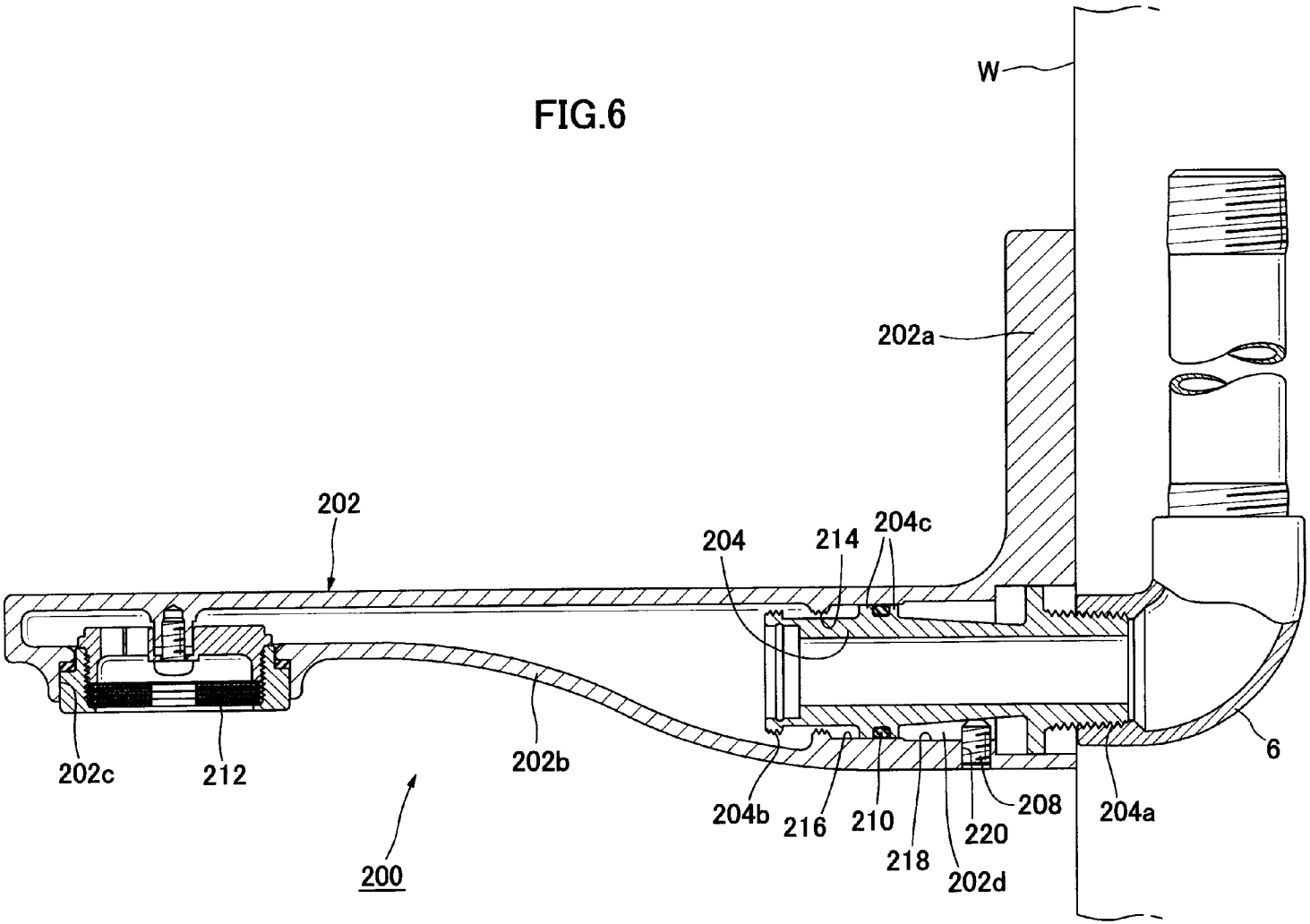
FIG. 6 is a sectional view of a spout according to a third embodiment of the present invention.

With reference to FIG. 6, a third embodiment of a spout or a water discharge device according to the present invention will be described. FIG. 6 is a sectional view of the spout according to the third embodiment.

As shown in FIG. 6, the spout 200 according to the third embodiment comprises a spout body 2 which serves as a device body, a connector 204 adapted to be joined to a feedwater pipe 6 arranged in a wall W, and a setscrew 208 which serves as fixing means for fixing the spout body 202 to the connector 204. The spout 200 further includes an O-ring 210 which serves as sealing means disposed between the connector 204 and the spout body 202.

The spout body 202 is a generally L-shaped member which has an base section 202*a* adapted to be disposed in contact with the wall W for mounting the spout 200 thereon, and a horizontal section 202*b* extending horizontally from a lower end of the base section 202*a*. The horizontal section 202*b* has an internal space formed as a water flow passage for passing therethrough cold/hot water to be discharged, and a distal end formed with a water discharge opening 202*c*. The water discharge opening 202*c* is adapted to allow a flow-distribution net 212 to be mounted thereto.

The horizontal section 202*b* has a base end formed as a connector receiving region 202*d* for receiving therein a distal end of the connector 204. The connector receiving region 202*d* has a distalmost end formed as an engaging internally-threaded protrusion 214 which serves as a body-side engaging thread portion. Further, the connector receiving region 202*d* includes a water-sealing cylindrical portion 216 formed on the side of the base end relative to the engaging internally-threaded protrusion 214 and adapted to be in close contact with the O-ring 210 so as to ensure water-tightness, and a large-diameter portion 218 formed on the side of the base end relative to the water-sealing cylindrical portion 216 to have an inner diameter greater than that of the water-sealing cylindrical portion 216. The setscrew 208 is adapted to be screwed into an internal-thread 220 formed in a bottom wall of the horizontal section 202*b* in a radial direction of the connector receiving region 202*d*. Specifically, the internal-thread 220 is formed to extend to penetrate through the large-diameter portion 218 of the connector receiving region 202*d*.

The connector 204 is a generally cylindrical-shaped member internally formed with a water flow passage. The connector 204 has a base end formed as a taper-shaped externally-threaded portion 204*a* which serves as a feedwater-pipe-joining portion adapted to be water-tightly engaged with the feedwater pipe 6 arranged in the wall W. The connector 204 has a distal end formed as an engaging externally-threaded protrusion 204*b* which serves as a connector-side engaging thread portion adapted to be engaged with the engaging internally-threaded protrusion 214 of the spout body 202 once during an operation of attaching the spout body 2 to the connector 204. Each of the engaging internally-threaded protrusion 214 and the engaging externally-threaded protrusion 204*b* has a relatively short length equivalent to about two threads. The connector 204 further includes two annular-shaped protrusions 204*c* formed on an outer peripheral surface thereof between the taper-shaped externally-threaded portion 204*a* and the engaging externally-threaded protrusion 204*b* to position the O-ring 210 therebetween.

With reference to FIG. 6, an operation of installing the spout 200 according to the third embodiment will be described below.

As a first step, the taper-shaped externally-threaded portion 204*a* of the connector 4 is engaged with a reverse taper-shaped internally-threaded end of the feedwater pipe 6 arranged in the wall W, to fix the connector 204 to the feedwater pipe 6.

Then, the spout body 202 is attached to the connector 204. In this step, the spout body 202 is firstly disposed to allow the connector receiving region 202*d* of the spout body 202 to receive therein the connector 204 fixed in such a manner as to protrude from the wall W. Then, when the connector 204 is inserted into the connector receiving region 202*d* of the spout body 202, the engaging externally-threaded protrusion 204*b* at the distal end of the connector 204 is brought into contact with the engaging internally-threaded protrusion 214 at the distalmost end of the connector receiving region 202*d*. In this position, the spout body 2 is moved to align an axis of the engaging internally-threaded protrusion 214 with the engaging externally-threaded protrusion 204*b*, and then rotated to engage the engaging internally-threaded protrusion 214 with the engaging externally-threaded protrusion 204*b*. As mentioned above, each of the engaging externally-threaded protrusion 204*b* and the engaging internally-threaded protrusion 214 has about two threads. Thus, when the spout body 202 is rotated about two turns relative to the connector 204, the engaging internally-threaded protrusion 214 of the spout body 202 is moved beyond the engaging externally-threaded protrusion 204*b* of the connector 204 to release the thread engagement therebetween. From this released position, the spout body 202 can be simply pushed toward the wall W without an operation of rotating the spout body 202, while allowing the connector 204 to be further inserted into the connector receiving region 202*d*.

In conjunction with the operation of further pushing the spout body 202 toward the wall W, the O-ring 210 fitted on the outer peripheral surface of the connector 204 is moved from the large-diameter portion 218 into the water-sealing cylindrical portion 216 of the connector receiving region 202*d*. This makes it possible to ensure water-tightness between the connector 204 and the spout body 202. The, the spout body 202 is further pushed until the base section 202*a* comes into contact with the wall W. In this position, the spout body 202 is rotated to adjust an installation angle in such a manner that the bottom wall of the horizontal section 2*b* is accurately oriented downwardly, and the setscrew 208 is tightened up, as the final step. Through the tightening of the setscrew 208, a tip of the setscrew 208 is pressed against the outer peripheral surface of the connector 204 to allow the spout body 202 to be fixed to the connector 204.

In use of the spout 200 according to the third embodiment, cold/hot water supplied from the feedwater pipe 6 is passed through the water flow passage of the connector 204 and the water flow passage of the horizontal section 202*b* and discharged through the flow-distribution net. During the use, due to a feedwater pressure, the spout body 202 receives a force in a direction causing the spout body 202 to be pulled out of the connector 204, and a force causing vibrations of the spout body 202. In normal use conditions, the spout body 202 fixed by the setscrew 208 is never pulled out of the connector 204 even if it receives such a feedwater pressure. Further, during the operation of attaching the spout body 202, the engaging internally-threaded protrusion 214 of the spout body 202 has been engaged with the engaging externally-threaded protrusion 204*b* of the connector 204 once and then moved beyond the engaging externally-threaded protrusion 204*b*. Thus, even if the spout body 202 is displaced in the direction causing pullout from the connector 204 due to insufficient tightening force of the setscrew 208 or erroneous skipping of an operation of tightening up the setscrew 208, the engaging internally-threaded protrusion 214 of the spout body 202 will be brought into contact with, i.e., engaged by, the engaging externally-threaded protrusion 204*b* of the connector 204, to prevent the spout body 202 from falling off the connector 204.

In addition, if the spout body 202 is displaced from a given or proper installation position illustrated in FIG. 6, the O-ring 210 which has been in close contact with the water-sealing cylindrical portion 216 of the connector receiving region 202*d* will face the large-diameter portion 218 of the connector receiving region 202*d*. Thus, the water-tightness based on the O-ring 210 is lost. This causes leakage of cold/hot water from between the spout body 202 and the connector 204 to outside, to allow a user to immediately recognize that the spout body 202 is displaced from the proper installation position.

In the spout according the third embodiment, even when the setscrew becomes loose due to long-term use or other factor, the engaging relationship between the engaging internally-threaded protrusion of the spout body and the engaging externally-threaded protrusion of the connector can be maintained to more reliably prevent falling-off of the spout body.

Figure 7:
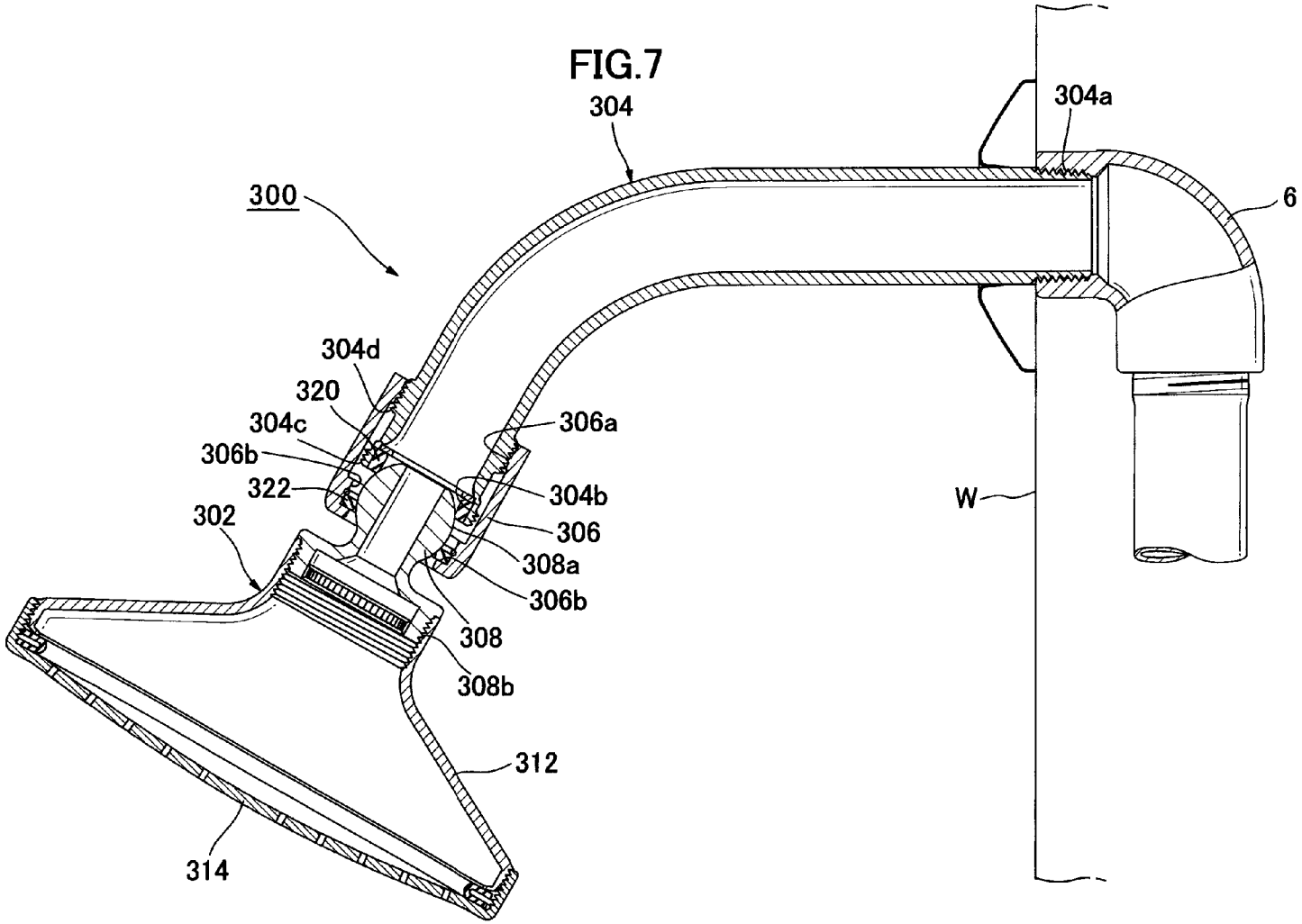
FIG. 7 is a sectional view of an overhead-showering showerhead according to a fourth embodiment of the present invention.

With reference to FIG. 7, a fourth embodiment of an overhead-showering showerhead or a water discharge device according to the present invention will be described below. FIG. 7 is a sectional view of the showerhead according to the fourth embodiment.

As shown in FIG. 7, the shower head 300 according to the fourth embodiment comprises a showerhead body 302 which serves as a device body adapted to be attached in a swingable manner, and a connector 304 adapted to be attached to a feedwater pipe 6 arranged in a wall W.

The showerhead body 302 includes a fixing cover 306 for fixing the showerhead body 302 to the connector 304, a pivot shaft 308 adapted to be swingably clamped between the fixing cover 306 and the connector 304, and a frame member 312 having a water spray plate 314 attached thereto.

The connector 304 is a circular tube-like member bent in a dogleg shape. The connector 304 has a base end formed as a taper-shaped externally-threaded portion 304*a* which serves as a feedwater-pipe-joining portion adapted to be engaged with a reverse taper-shaped internally-threaded end of the feedwater pipe 6, and a distal end formed as a pivot-receiving portion 304*b* adapted to receive therein the pivot shaft 308. An annular-shaped packing 320 is disposed in the pivot-receiving portion 304*b* to ensure water-tightness between the pivot shaft 308 and the pivot-receiving portion 304*b*. On the distal-most end, the connector 304 is formed with an engaging externally-threaded protrusion 304*c* serving as a connector-side engaging thread portion. In this embodiment, the engaging externally-threaded protrusion 304*c* is formed to have about two threads.

Further, the connector 304 is formed with a fixing externally-threaded protrusion 304*d* at a position spaced apart from the engaging externally-threaded protrusion 304*c*. A distance between the engaging externally-threaded protrusion 304*c* and the fixing externally-threaded protrusion 304*d* is set at a value greater than a length of an after-mentioned engaging internally-threaded protrusion 306*a* formed in the fixing cover 306.

The pivot shaft 308 is a generally cylindrical-shaped member formed with a water flow passage extending in an axial direction thereof. The pivot shaft 308 has a base end with an outer surface formed as a spherical surface 308*a* for allowing the showerhead body 302 to be pivotally connected to the connector 304, and a distal end formed as a connecting externally-threaded portion 308*b* threadingly engageable with the frame member 312.

The fixing cover 306 is a generally cylindrical-shaped member adapted to be threadingly engaged with the connector 304 to clamp the pivot shaft 308 in cooperation with the pivot-receiving portion 304*b* of the connector 304. The fixing cover 306 has a base end formed with an engaging internally-threaded protrusion 306*a* serving as a body-side engaging thread portion. In an operation of attaching the fixing cover 306 to the connector 304, the engaging internally-threaded protrusion 306*b* is engaged with the engaging externally-threaded protrusion 304*c* of the connector 304 once. Then, the engaging internally-threaded protrusion 306*b* after being moved beyond the engaging externally-threaded protrusion 304*c* is engaged with the fixing externally-threaded portion 304*d* to fix the fixing cover 306 to the connector 304. That is, the engaging internally-threaded protrusion 306*b* serves as both a body-side engaging thread portion adapted to be engaged with the engaging externally-threaded protrusion 304*c*, and a fixing thread portion or fixing means for attaching the showerhead body 302 to the connector 304. In this embodiment, the engaging internally-threaded protrusion 306*b* is formed to have about two threads.

The fixing cover has a distal end formed as a doughnut-shaped clamping portion 306*b* having an inner diameter less than a diameter of the spherical surface 308*a* of the pivot shaft 308, and an annular-shaped packing 322 is disposed inside the clamping portion 306*b*. The spherical surface 308*a* of the pivot shaft 308 is clamped between this packing 322 and the packing 320 disposed in the pivot-receiving portion 304*b*, so as to support the pivot shaft 308 in a pivotally swingable manner.

The frame member 312 is a generally cylindrical-shaped member, and the connecting externally-threaded portion 308*b* of the pivot shaft 308 is threadingly engaged with a base or top end of the frame member 312. The water spray plate 314 is attached to a distal or bottom end of the frame member 312

With reference to FIG. 7, an operation of installing the overhead-showering showerhead 300 according to the fourth embodiment will be described below.

As a first step, the taper-shaped externally-threaded portion 304*a* of the connector 304 is engaged with the reverse taper-shaped internally-threaded end of the feedwater pipe 6 arranged in the wall W, to water-tightly fix the connector 304 to the feedwater pipe 6. The fixing cover 306, the pivot shaft 308, the frame member 312 and the water spray plate 314 are assembled together in advance as shown in FIG. 7, and this assembled unit is fixed to the connector 304. Specifically, the fixing cover 306 is moved to align an axis of the engaging internally-threaded protrusion 306*a* formed on the base end of the fixing cover 306, with that of the engaging externally-threaded protrusion 304*c* formed on the distal end of the connector 304, and then rotated to engage the engaging internally-threaded protrusion 306*a* with the engaging externally-threaded protrusion 304*c*. As mentioned above, each of the engaging internally-threaded protrusion 306*a* and the engaging externally-threaded protrusion 304*c* is formed to have about two threads. Thus, after the engaging internally-threaded protrusion 306*a* and the engaging externally-threaded protrusion 304*c* are engaged with each other, the fixing cover 306 can be rotated about two turns to allow the engaging internally-threaded protrusion 306*a* to be moved beyond the engaging externally-threaded protrusion 304*c*.

The engaging internally-threaded protrusion 306*a* after being moved beyond the engaging externally-threaded protrusion 304*c* is located in a non-threaded region of the connector 304 between the engaging externally-threaded protrusion 304*c* formed on the distal end thereof and the fixing externally-threaded portion 304*d* formed on the side of the base end relative to the engaging externally-threaded protrusion 304*c*. While the fixing cover 306 is displaceable relative to the connector 304 when it is located in the non-threaded region, the engaging internally-threaded protrusion 306*a* is brought into contact with, i.e., engaged by, the engaging externally-threaded protrusion 304*c* to preclude the fixing cover 306 from being pulled out of the connector 304.

Then, the fixing cover 306 is moved to align the axis of the engaging internally-threaded protrusion 306*a* of the fixing cover 306 with an axis of the fixing externally-threaded portion 304*d* of the connector 304, and then rotated to engage the engaging internally-threaded protrusion 306*a* with the fixing externally-threaded portion 304*d*. When the fixing cover 306 is screwed into the connector 304, the spherical surface 308*a* of the pivot shaft 308 is clamped between the packings 322, 322. When the fixing cover 306 is further threadingly moved up to a given position, the packings 322, 322 are adequately compressed to ensure water-tightness between the connector 304 and the pivot shaft 308. In this position, the showerhead body 302 can be pivotally swung based on a sliding movement of the spherical surface 308*a* of the pivot shaft 308 relative to the packing 320, and then stopped at any position based on friction between the spherical surface 308*a* and the packing 320.

In an actual use of the overhead-showering showerhead 300 according to the fourth embodiment, cold/hot water supplied from the feedwater pipe 6 is discharged from water spray holes of the water spray plate 314 via the connector 304, the pivot shaft 308 and the frame member 312. According to user's preference, the showerhead body 302 can be swingingly moved in any direction and stopped at an intended position.

Even if fastening based on the thread engagement between the connector 304 and the fixing cover 306 becomes loose due to long-term use or other factor, water-tightness between the pivot shaft 308 and the packing 320 will be lost to cause leakage of cold/hot water from therebetween to outside. This makes it possible to allow a user to immediately recognize that the showerhead body 302 is displaced from a given or proper installation position due to loose in fastening of the fixing cover 306. Further, even if the engaging internally-threaded protrusion 306*a* of the fixing cover 306 is disengaged from the fixing externally-threaded portion 304*d* of the connector 304, the engaging internally-threaded protrusion

306*a* will be brought into contact with, i.e., engaged by, the engaging externally-threaded protrusion 304*c* of the connector 304 to prevent that falling-off of the showerhead body 302.

In the body-showering showerhead according the fourth embodiment, even when the thread engagement between the connector and the fixing cover becomes loose due to long-term use or other factor, the engaging relationship between the engaging internally-threaded protrusion of the showerhead body and the engaging externally-threaded protrusion of the connector can be maintained to more reliably prevent falling-off of the showerhead body.

What is claimed is:

1. A showerhead comprising:

a showerhead body having a base section adapted to be disposed in contact with a wall for mounting the showerhead thereon, and a horizontal section extending horizontally from an upper end of said base section; said horizontal section has an internal space formed as a water flow passage, a distal end formed with a water discharge opening and a base end formed a connector receiving region; said connector receiving region has a distalmost end formed a body-side engaging thread portion, wherein said body-side engaging thread portion is internally threaded;

a connector is mounted within said internal space and at said connector receiving region of said showerhead body; said connector having a base end formed as a feedwater-pipe-joining portion adapted to be attached to a feedwater pipe arranged in the wall, and a distal end formed as a connector-side engaging thread portion, wherein said connector-side engaging thread portion is externally threaded; said connector-side engaging thread portion of said connector engaging said body-side engaging thread portion of said showerhead body during an initial operation of attaching said showerhead body to said connector, said body-side engaging thread portion rotating beyond said connector-side engaging thread portion to completely releasing the thread engagement therebetween and enabling said showerhead body to be moved axially through a limited range and freely rotated relative to said connector; and a fastener for fixing said showerhead body to said connector at a given installation position once said connector-side engaging thread portion and body-side engaging thread portion are completely released, wherein said body-side engaging thread portion is positioned between and spaced from said connector-side engaging thread portion and said fastener when said showerhead body is fixed at said given installation position.

2. The showerhead according to claim 1, further including sealing means adapted to provide water-tightness between said showerhead body and said connector, said sealing means being adapted to lose said water-tightness when said showerhead body is displaced from said installation position.

3. The showerhead according to claim 1, wherein said fastener is a setscrew which is screwed in said showerhead body and adapted to allow a tip thereof to be in contact with said connector.

4. The showerhead according to claim 2, wherein said fastener is a setscrew which is screwed in said showerhead body and adapted to allow a tip thereof to be in contact with said connector.

* * * * *